United States Patent [19]

Stringfellow

[11] Patent Number: 4,711,301

[45] Date of Patent: Dec. 8, 1987

[54] VALVE ASSEMBLY FOR INFLATABLE PACKER

[75] Inventor: William D. Stringfellow, Houston, Tex.

[73] Assignee: Weatherford U.S., Inc., Houston, Tex.

[21] Appl. No.: 773,410

[22] Filed: Sep. 5, 1985

[51] Int. Cl.[4] ..... E21B 33/127

[52] U.S. Cl. ..... 166/187; 166/321; 277/34.6

[58] Field of Search ..... 166/187, 319-321, 166/323; 277/3, 34, 34.3, 34.6

[56] References Cited

U.S. PATENT DOCUMENTS

| | | | |
|---|---|---|---|
| 2,177,601 | 10/1939 | Smith | 166/10 |
| 3,053,322 | 9/1962 | Kline | 166/184 |
| 3,085,628 | 4/1963 | Malone | 166/187 |
| 3,437,142 | 4/1969 | Conover | 166/277 |
| 3,524,503 | 8/1970 | Baker | 166/289 |
| 3,542,127 | 11/1970 | Malone | 166/122 |
| 3,749,119 | 7/1973 | Tausch et al. | 137/461 |
| 3,779,263 | 12/1973 | Edwards et al. | 137/68 |
| 3,818,922 | 6/1974 | Malone | 137/70 |
| 3,826,309 | 7/1974 | Tausch | 166/224 |
| 4,082,298 | 4/1978 | Sanford | 277/34.3 |
| 4,260,164 | 4/1981 | Baker et al. | 277/34 |
| 4,299,397 | 11/1981 | Baker et al. | 277/34 |
| 4,316,504 | 2/1982 | Baker et al. | 166/53 |
| 4,332,298 | 6/1982 | Kuus et al. | 166/319 |
| 4,402,517 | 9/1983 | Wood et al. | 166/187 |
| 4,474,380 | 10/1984 | Carter, Jr. | 277/34.6 |
| 4,527,625 | 7/1985 | Wood et al. | 166/187 |
| 4,586,526 | 5/1986 | Reardon | 166/187 |

OTHER PUBLICATIONS

CTC Completion Tool Company Isozone Valve System.
McAllister Annulus Casing Packer (ACP).
Lynes External Casing Packer.
CTC Completion Tool Company Completion Technology Company Group.
Lynes Product Catalog 1982-1983.
TAM International 1982-1983 General Catalog.
TAM International Heavy Duty TAM J. Inflatable Packers Isolate Zones for Well Testing and Workovers.

*Primary Examiner*—James A. Leppink
*Assistant Examiner*—William P. Neuder
*Attorney, Agent, or Firm*—Vaden, Eickenroht Thompson & Boulware

[57] ABSTRACT

A multi-function valve assembly for controlling fluid flow through a single cavity, the valve assembly being particularly suited for use with an inflatable packer in a well bore. The valve assembly includes a control valve sliding piston in one end of a cavity such as a cavity in an inflatable packer, the cavity communicating between the interior of a tubular (such as well casing) and an annulus between the tubular and a wellbore in which the tubular is positioned. The control valve sliding piston isolates the packer until a certain predetermined pressure is reached, at which point it moves in response to the pressure of the fluid in the casing, thereby permitting flow of fluid from the casing into an inflatable bladder in the packer. An over-pressure piston disposed in the same cavity senses the packer inflation pressure and moves the control valve piston to close the valve, halting further inflation. A balancing locking stem is mounted within the cavity and both the control valve piston and the overpressure piston move in the cavity about this stem. The stem moves into the recess of an annulus gland in response to the action of the control valve piston.

33 Claims, 15 Drawing Figures

VALVE ASSEMBLY FOR INFLATABLE PACKER

BACKGROUND OF THE INVENTION

1. Field of the Invention

The present invention relates to a multi-function valve assembly for use in a single cavity, which is particularly suited for use in an inflatable packer system. Inflatable packers are used, among other things, to isolate a zone in an uncased wellbore; to isolate a zone between the casing and the formation in a cased wellbore; or to isolate a zone between outer casing and interior or intermediate casing. A particular use is to sealingly isolate the annulus between casing and wellbore in a cased well for cementing operations, and similarly in pile grouting operations.

2. Description of the Prior Art

Efficient use of an inflatable packer requires a valve system which accomplishes the following:

1. Prevents inflation of the packer until a certain desired pressure in the casing is reached.
2. Permits the packer to inflate to a desired pressure.
3. Prevents the packer pressure from exceeding or falling below a certain desired level called the "setting pressure."
4. Isolates the casing pressure from pressure in the well annulus.

The Lynes ECP, the Xenpax Casing Packer, and the CTC Inflatable Casing Packer disclose valve systems which are typical of the prior art. In each of these prior art systems a plurality of valve mechanisms are employed to achieve the multiple purposes of an efficient system. The use of a plurality of independent valves requires a plurality of fluid flow paths or cavities between the casing, the annulus, and the interior of the inflatable packer. In short, the prior art inflatable packer valve systems are complicated, inefficient, and require expensive drilling of fluid flow paths or cavities. In addition to these considerations, various problems have been encountered with the prior art systems. Various prior art packers inflate prematurely or over-inflate due to the use of improper, defective shear pins or the use of incorrectly sized differential areas. In the prior art packers, if the packer element fails, the casing is not isolated from the annulus and unwanted communication of fluid from the casing to the annulus and vice-versa occurs. In the prior art systems using cross-drilled holes and valve pistons or stems which employ sealing "O" rings, the "O" rings can be damaged or completely severed by movement across the edges of the multiple cross-drilled holes.

SUMMARY OF THE INVENTION

The valve assembly according to the present invention accomplishes in a single cavity all of the desired functions of an inflatable packer valve system. The valve assembly includes a control valve sliding piston mounted in one end of a cavity which communicates between the interior of the casing and the annulus between the casing and the wellbore. The piston isolates the inflatable packer until a certain pressure has been reached, at which point it moves in response to the pressure of the fluid in the casing permitting flow of fluid from the casing into the inflatable bladder of the packer. An overpressure piston senses packer inflation pressure and, at a preselected inflation pressure moves the control valve piston to close the valve, bringing inflation to a halt. If the bladder ruptures, the annulus pressure acting on the control valve sliding piston moves the piston to its initial closed position to shut off flow from the casing through the valve.

The control valve sliding piston moves within the cavity in response to casing pressure on one side or the pressure on the overpressure piston on the other. A balancing locking stem is mounted within the cavity and both the control valve sliding piston and the overpressure piston move in the cavity about the balancing locking stem. An annulus gland is mounted in the cavity and has a recess for receiving the balancing locking stem. The stem moves into the recess of the annulus gland in response to the action of the control valve piston.

The advantages of a valve assembly according to the present invention include, inter alia, the following:

1. the control piston is fully guided;
2. design variations are possible, e.g. the use of varying differential area;
3. seals and "O" rings never pass directly over a cutting edge;
4. the need for multiple cavities and flow paths is eliminated;
5. the need for multiple independent valves is eliminated;
6. and accurate operation is made possible.

To one of ordinary skill in the art having the benefit of this invention's teachings, other features and advantages of the present invention will be clear from the following description of the presently preferred embodiment, given for the purpose of disclosure, when taken in conjunction with the accompanying drawings.

DESCRIPTION OF PREFERRED EMBODIMENTS

Figure 1A:
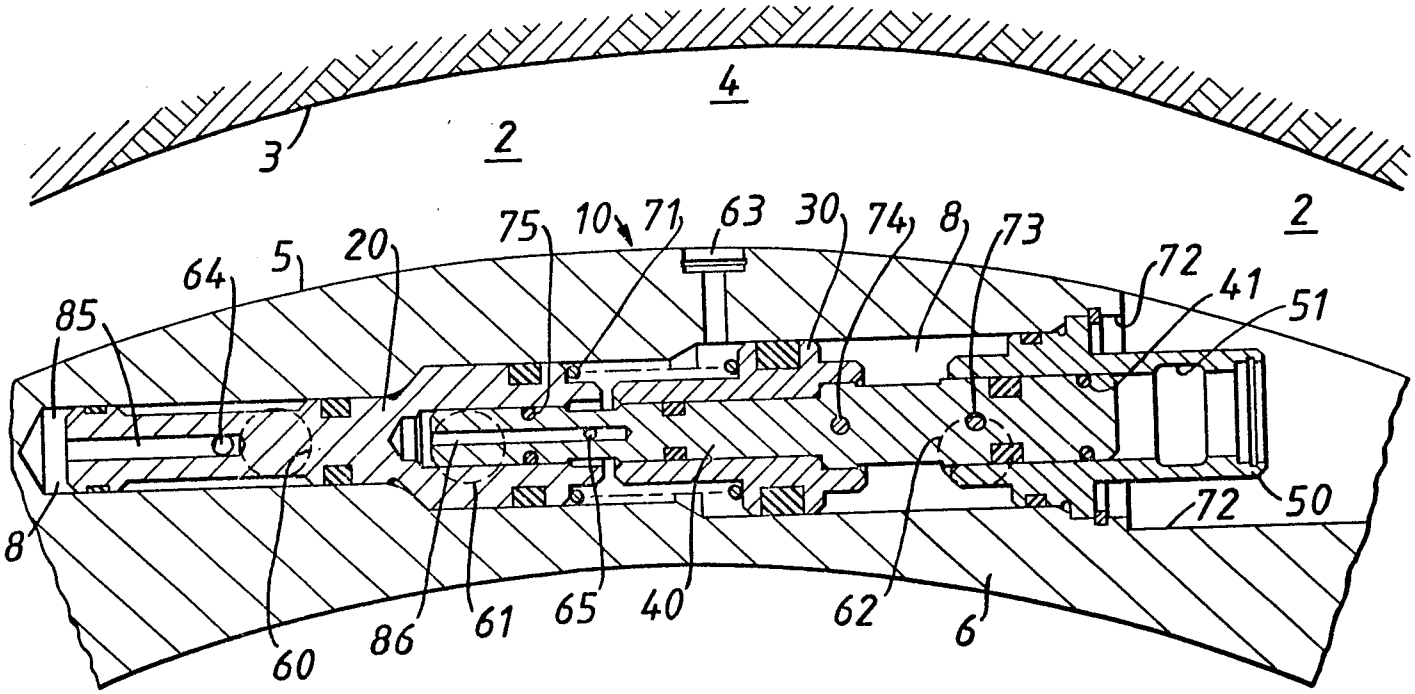
FIG. 1*a* is a top cross sectional view of a valve assembly according to the present invention in a single cavity in a casing coupling within a wellbore.

As shown in FIGS. 1*a*, 1*f*, 2, 3, 4 the valve assembly 10 is mounted in the cavity 8 in the casing 6. The casing 6 is within the wellbore 4. ("Casing" includes any special coupling used to connect a packer to a string of casing; in the preferred embodiments the valve assembly is mounted in a cavity in a casing coupling). The annulus 2 is the zone formed between the wellbore wall 3 and the exterior wall 5 of the casing 6.

The valve assembly 10 has four primary parts: the control valve sliding piston 20; the overpressure piston 30; the balancing locking stem 40; and the annulus gland 50. Various parts of a typical valve assembly according to the present invention are illustrated (to scale) in FIGS. 1*b*–1*e*; namely parts from the embodiment of FIG. 1*a* including: the control valve sliding piston 20, FIG. 1*b*; the balancing locking stem 40, FIG. 1*c*; the annulus gland 50, FIG. 1*d*; and the overpressure piston, FIG. 1*e*.

The control valve sliding piston 20 is movably mounted within the cavity 8 and the fit is such that the piston 20 is guided by the walls of the cavity 8. The piston 20 is also movable about the blocking locking stem 40 and the fit between the piston 20 and the stem 40 is such that the stem 40 serves to guide the piston 20, and vice versa.

The overpressure piston 30 is movably mounted within the cavity 8 adjacent the control valve sliding piston 20, but in the static valve closed position of FIG. 1 overpressure piston 30 is not in contact with the piston 20. The fit is such between the overpressure piston 30 and the walls of the cavity 8 that the walls serve to guide the piston. Also the overpressure piston 30 is movable about the blocking locking stem 40 and the fit between them is such that the stem 40 serves to guide the piston 30, and vice versa. The spring 71 is disposed between the piston 20 and the piston 30.

The annulus gland 50 is immovably mounted at the end of the cavity 8 opposite from the end holding the control valve sliding piston 20. The annulus gland 50 receives and guides one end of the blocking lock stem 40.

Various openings or "ports" permit sources of pressure to act on the various parts of the valve assembly 10. The fluid under pressure in the casing 6 is communicated to the control valve sliding piston via the casing port 60. When the valve assembly 10 is in an open position, the fluid in the casing flows under pressure past the piston 20 and into the inflatable bladder element 80 via the bladder port 61. The pressure of the fluid in the bladder element 80 is sensed by the overpressure piston 30 via the overpressure port 62. The pressure of the fluid in the annulus acts on both the control valve sliding piston 20 and the overpressure piston 30 via the annulus port 63. The pressure of fluid in the annulus also acts on the blocking locking stem 40 via the recess 72 at the open end of the cavity 8 in the casing. FIGS. 1*f*–1*i* show the arrangement and relative positions of the various flow paths within the coupling and casing in which the valve assembly 110 is mounted. In the side view of FIG. 1f the ports 60, 61 and 62 are shown. Casing fluid flows to the cavity 8 and, when the valve assembly 10 is in an open position, through ports 60 and 61 into the bladder element 80. A portion of the fluid in the bladder element 80 is returned to the cavity 8 through the overpressure port 62 to act on the overpressure piston 30.

Figure 1B:
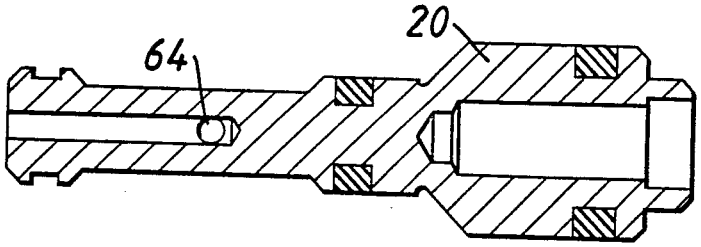
FIGS. 1*b*–1*e* are cross sectional views of the major parts of the valve assembly of FIG. 1*a*.
Figure 1C:
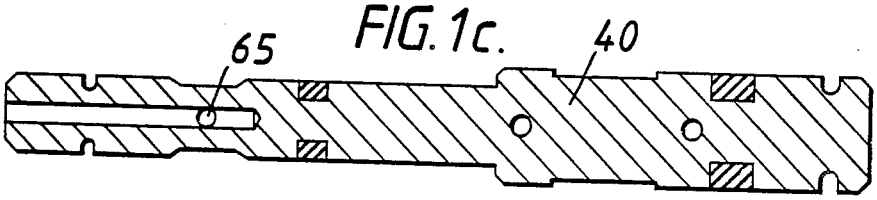
Figure 1D:
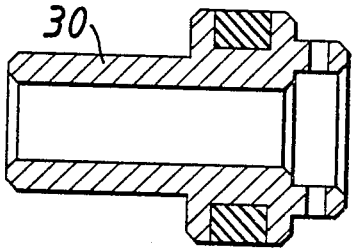
Figure 1E:
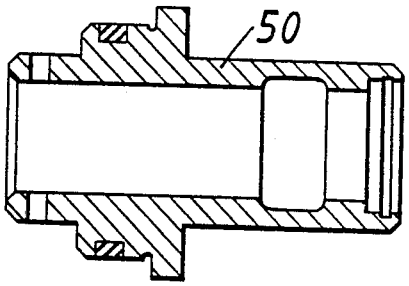
Figure 1F:
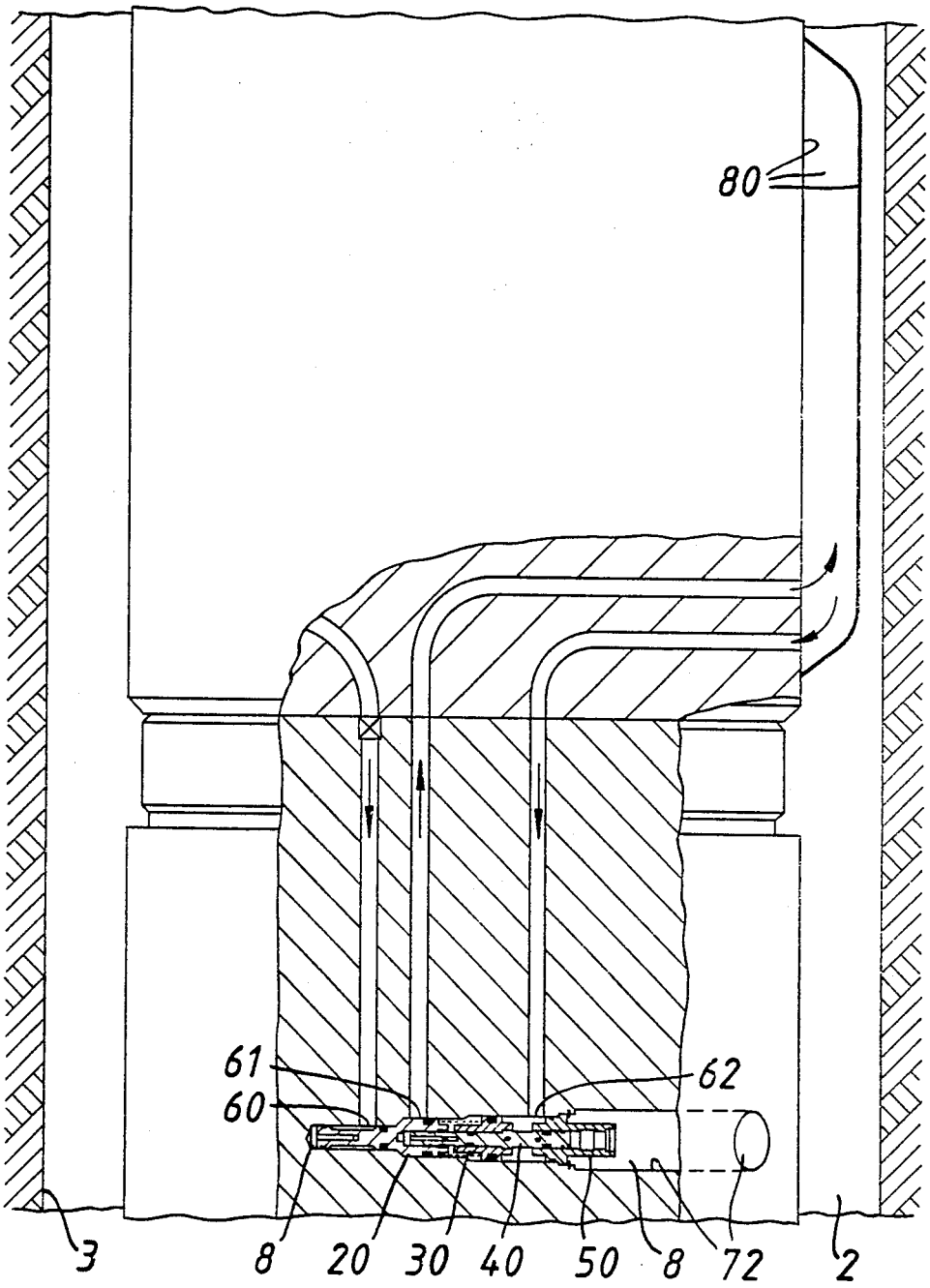
FIG. 1*f* is a side view, partially cut away of a valve assembly according to the present invention within a casing coupling.
Figure 1G:
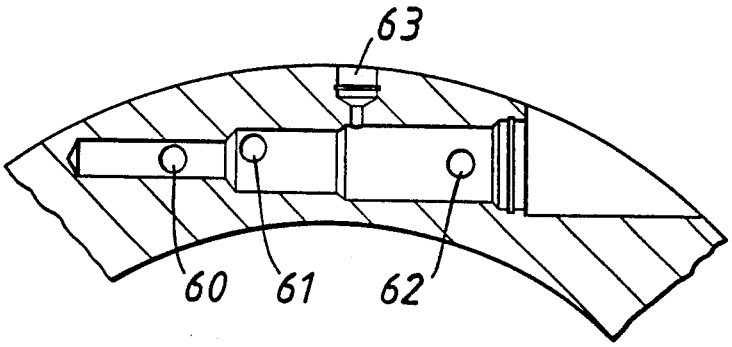
FIG. 1*g* is a sectional view along lines A—A of FIG. 1*h*.
Figure 1I:
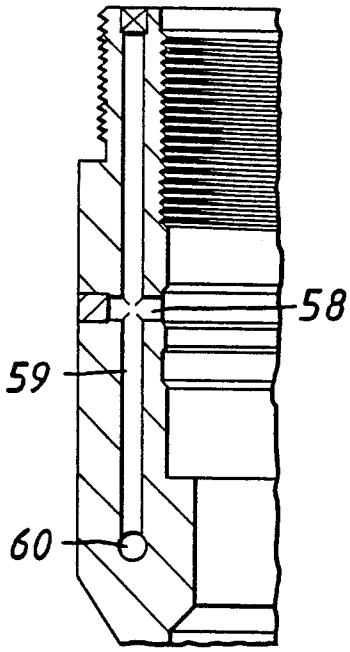
FIG. 1*i* is our enlargement of the portion of the coupling containing the channels to the casing fluid port of the cavity for the valve assembly.
Figure 1H:
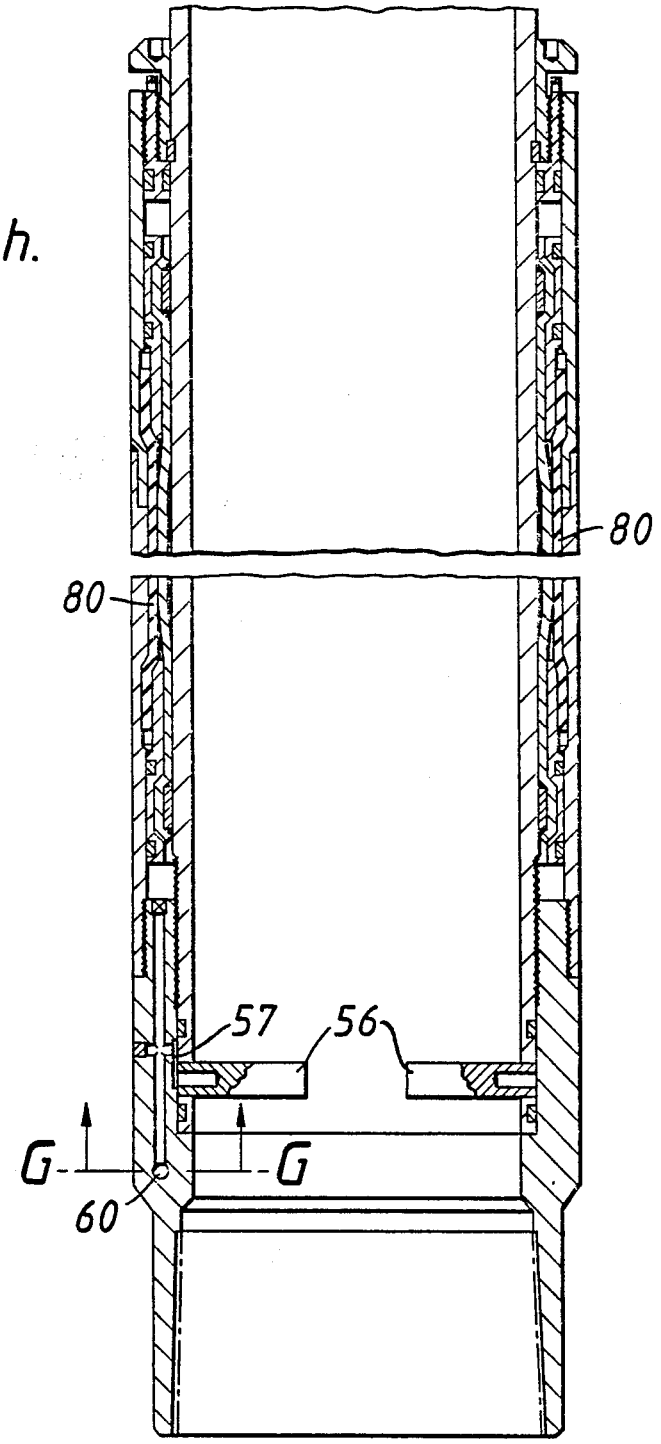
FIG. 1*h* is a cross sectional view of a casing coupling and casing with inflatable packer showing the port for casing fluid to enter the cavity for holding a valve assembly according to the present invention.

The cross sectional views of FIGS. 1*h* and 1*i* show the knock-off plug 56 which blocks the channels 57, 58, 59 leading to the casing port 60. Casing fluid cannot flow through the casing port 60 until the plug 56 has been removed. FIG. 1*g* shows a top view taken along line A—A of FIG. 1*h* illustrating the configuration of the ports 60–63.

Shear pins are utilized to: (1) keep the valve from opening until a certain preselected pressure is reached within the casing; and (2) to close the valve when a desired pressure ("setting pressure") is achieved within the bladder element 80. The opening shear pin 73 holds the blocking locking stem 40 immobile, and consequently holds the overpressure piston 30 immobile and the control valve sliding piston immobile when it first contacts the overpressure piston 30. Only when the pressure on the control valve sliding piston 20 from the casing fluid has reached a predetermined level does the shear pin 73 shear off permitting movement of the stem 40, piston 30 and piston 20.

The closing shear pin 74 holds the overpressure piston 30 immobile on the blocking locking stem 40 until the pressure of the fluid in the bladder element 80 acting on the overpressure piston 30 via the overpressure port 62 reaches a predetermined level, at which point the bladder element 80 is inflated to the desired pressure. At this point the closing shear pin 74 shears off permitting the overpressure piston 30 to move the control valve sliding piston 20 to close the valve thereby stopping the flow of fluid into the bladder element 80.

The balancing locking stem 40 carries the locking ring 75 which can expand to abut the end of the control valve sliding piston 20 locking the piston 20 in place.

Figure 2:
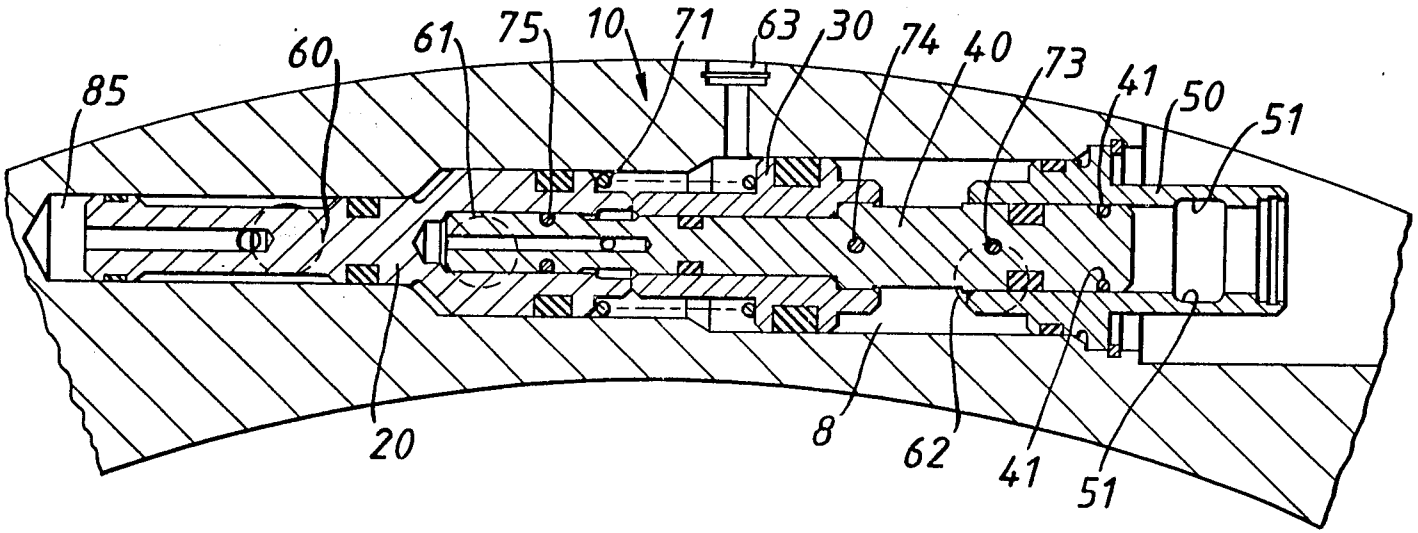
FIGS. 2–5 are top cross sectional views of the valve assembly of FIG. 1*a*.

FIG. 2 illustrates the commencement of opening of the valve assembly 10. The control valve sliding piston 20 has been moved slightly by the pressure of the casing fluid. The piston 20 has compressed the spring 71 and has contacted the overpressure piston 30 which is immobile on the balancing locking stem 40 since the closing shear pin 74 is still intact. The opening shear pin 73 is also intact but the force on it is building up.

Figure 3:
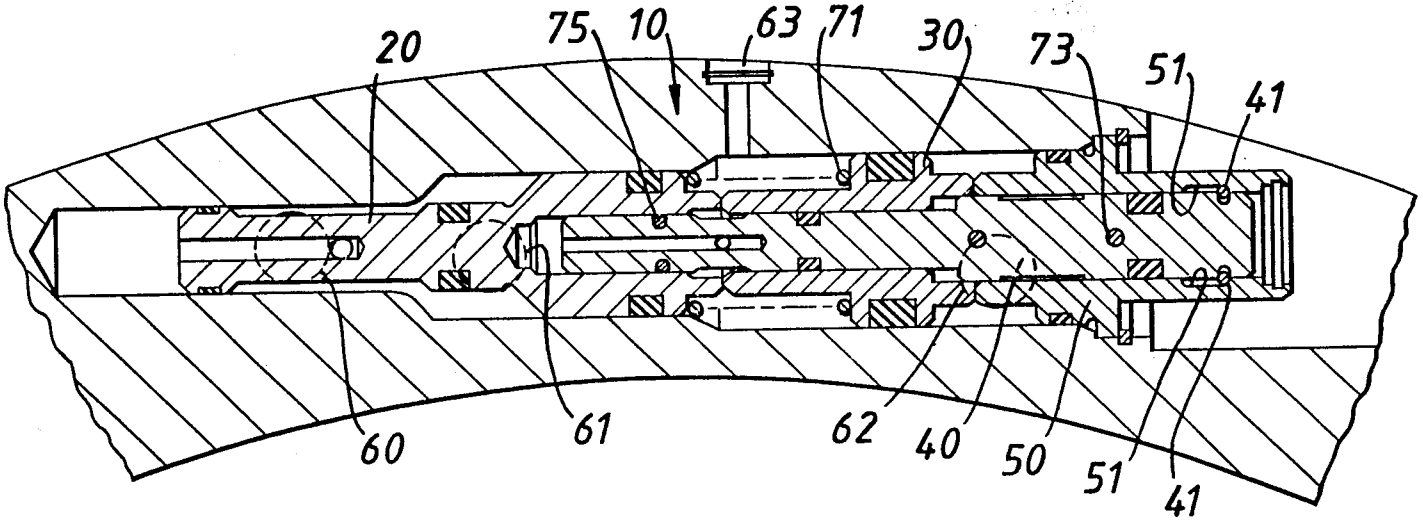

FIG. 3 illustrates the open position of the valve assembly 10. The pressure on the control valve sliding piston 20 communicated via the overpressure piston 30 to the balancing locking stem 40 and hence to the opening shear pin 73 has severed the pin 73 permitting the stem 40, the piston 30, and the piston 20 to move opening the casing port 60 so that the casing fluid flows from casing port 60, to bladder port 61 and into the bladder element 80 thereby inflating it. As the bladder element 80 is inflated, the pressure of the fluid in the bladder element 80 is communicated to the overpressure piston 30 and to the blocking locking stem 40 via the overpressure port 62. The expandable locking ring 41 on the blocking locking stem 40 has expanded outwardly from the stem 40 into the enlarged area of the recess 51 in the annulus gland 50. Slight movement of the stem 40 is possible since the width of the recess 51 is larger than the diameter of the ring 41. Since the stem 40 can be moved slightly, the locking ring 75 can be exposed when the control piston 20 moves to a closed position.

Figure 4:
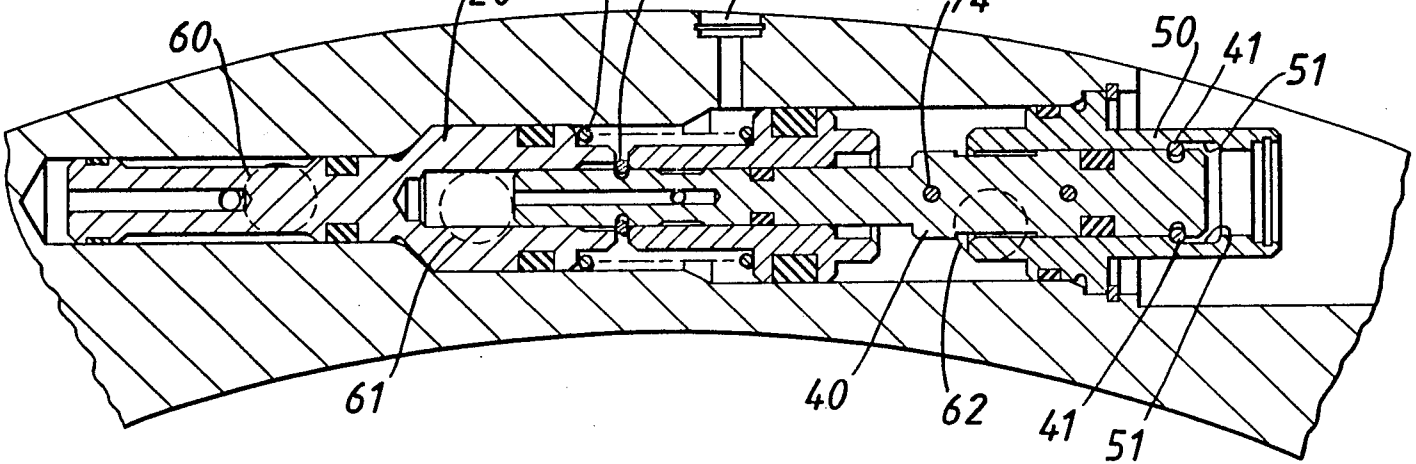

FIG. 4 illustrates the action of the valve assembly 10 in the event of a loss of pressure in the bladder element 80. As pressure is lost within the bladder element 80 (for whatever reason) the effect of the pressure of fluid in the bladder element 80 on the overpressure piston 30 and on the blocking locking stem 40 is reduced or eliminated. Thus the effect of the pressure of fluid in the annulus 2 on the control valve sliding piston 20 via the annulus port 63 forces the piston 20 toward a closed position. As shown in FIG. 4 the piston 20 has been moved back into a closed position, exposing and freeing the expandable locking ring 75. The locking ring 75 has expanded to about the piston 20 preventing movement of the piston 20 toward the overpressure piston 30 thereby locking the valve assembly 10 in a closed position, closing off ports 60 and 61, so that casing fluid no longer flows into the bladder element 80. The expansion of the locking ring 41 and its abutment against the wall of the recess 51 prevents further movement of the stem 40 toward the piston 20.

Figure 5:
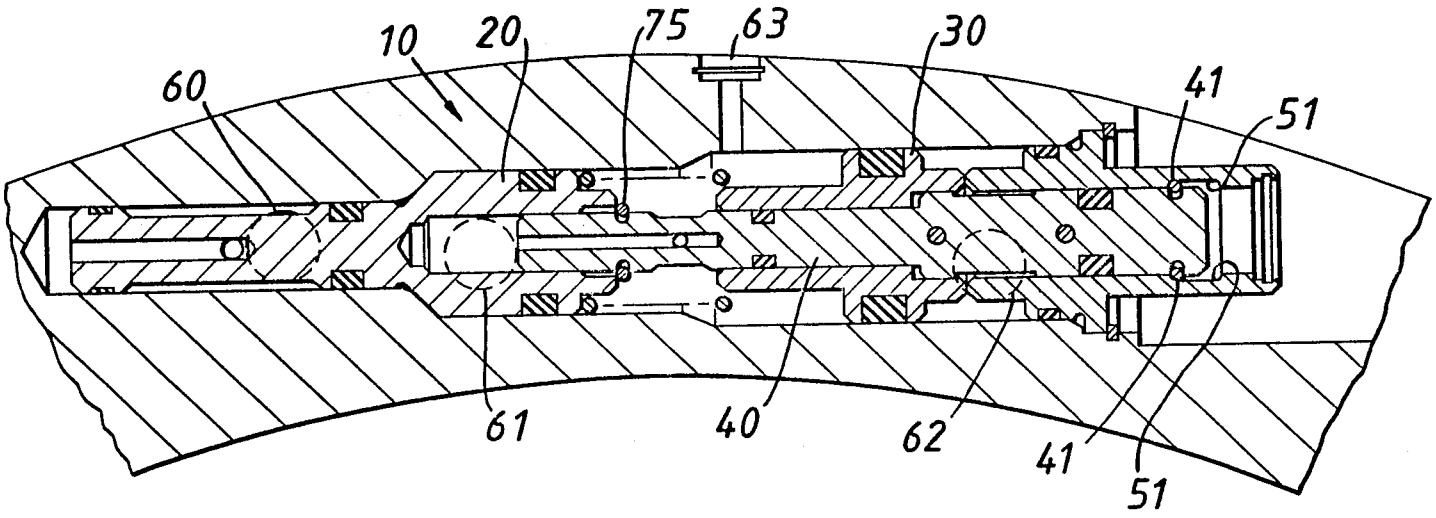

The normal closed position of the valve assembly 10 is shown in FIG. 5. The pressure of the fluid within the bladder element 80, communicated to the overpressure piston 30 via the overpressure port 62, has sheared the closing shear pin 74, releasing the overpressure piston 30. The overpressure piston 30 and the spring 71 have moved the control valve sliding piston into a closed position so that fluid no longer flows from the casing port 60 into the bladder element 80 through the bladder port 61. Also, piston 20 has moved so that the locking ring 75 has been exposed and freed expanding to abut the piston 20 and prevent its movement to an open position. The balancing locking stem 40 is restrained by the abutment of the expanded locking ring 41 against the edge of the recess 51.

Casing fluid also flows through the casing port 60 (see FIG. 1*a*) and then through the port 64 into the zone 85 to insure that no vacuum is formed in the zone 85 to impede motion of the control valve sliding piston 20. Also, casing fluid can flow from zone 85 out port 64 when the control valve sliding piston moves to close off bladder port 61, so that fluid trapped in zone 85 does not impede the motion of the piston 20 when it is returning to a closed position. Similarly, the port 65 is provided to permit annulus fluid to flow into the zone 86 so that motion of the balancing locking stem 40 is not impeded.

Figure 6:
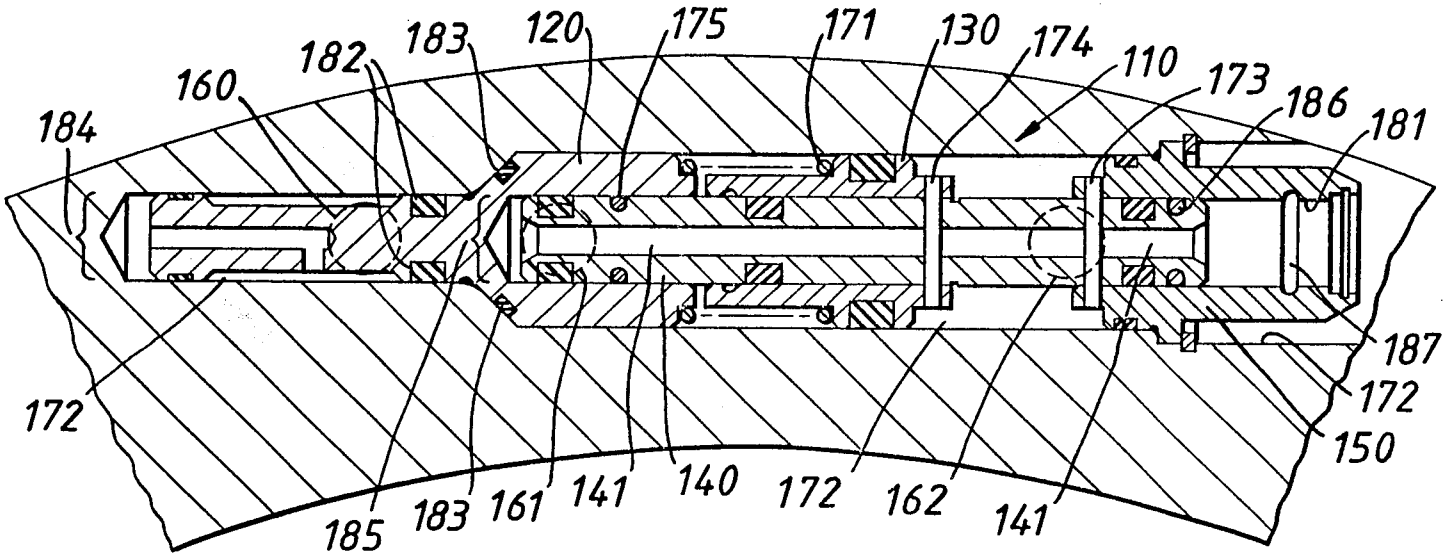
FIG. 6 is a top cross sectional view of another embodiment of a valve assembly according to the present invention.

In another embodiment as shown in FIG. 6, the pressure of the fluid in the annulus is communicated to the balancing locking stem 140 via the annulus pressure sensing port 181. The effect of the pressure of the annulus fluid is also communicated to the control valve sliding piston 120 via the port 181 through the channel 141 in the center of the balancing locking stem 140. The pressure of the fluid in the annulus affects both ends of the balancing locking stem 140 and, since the area of each end is the same and the pressure exerted is the same, the forces on each end (pressure times area) are the same. Therefore, the stem 140 moves only in response to forces applied to it by the pistons. Also the area of the control valve sliding piston 120 exposed to the effect of the pressure of the casing fluid, e.g. area 184, is the same as the area 185 of the balancing locking stem 140 exposed to the effect of the pressure of the fluid in the annulus. Since areas 184 and 185 are the same it is the strength of the opening shear pin 173 that determines when the valve assembly opens.

FIG. 6 also illustrates a safety feature which is preferred and which can be employed in any embodiment of the valve assembly according to this invention. The crown seal 182 insures that prior to movement of the control valve sliding piston 120 the casing fluid does not flow into the cavity 172 to a point beyond the crown seal 182. Because of the widened configuration of the cavity 172, when the control valve sliding piston 120 moves to open the valve, the crown seal 182 reaches a point at which it no longer touches the walls of the cavity 172 and hence, as is desired, provides no sealing action. In moving to this new position it is possible for the crown seal 182 to become deformed or damaged for example by pressure, flow, abrasives in the fluid, or rubbing against the angled edge of the cavity. When the control valve sliding piston moves to close off the bladder port 161 the crown seal 182 again moves into a sealing relationship with walls of the cavity 172. If the seal 182 has been deformed or damaged the seal created will be defective. To circumvent this potential problem a seal means, such as the O ring seal 183, can be provided in the face of the control valve sliding piston 120 which is in the wider part of the cavity 172, as shown in FIG. 6. When the piston 120 moves back to close off the bladder port 161, the seal 183 will contact the walls of the cavity 172 creating a seal to either back-up or replace the seal 182. The expandable locking ring 186 is provided which expands into the groove 187 upon movement of the balancing locking stem 140.

Because of the novel use of differentials in areas of the various faces of the parts exposed to pressure, a valve assembly according to the present invention provides very accurate and precise valve action, better control of inflatable element setting pressure, and more flexible and varied design possibilities. Generally the force on a particular part, e.g. a piston or a stem, is dependent on pressure level and area affected:

$$\text{Force} = (\text{Pressure}) \times (\text{Area})$$

In many prior art devices the areas utilized, e.g. on either side of a piston, are the same. Since the areas are the same the only variable is pressure, i.e., the prior art designs are constrained in that effects to be achieved must be achieved by pressure change.

According to the present invention area differentials can be employed with new and unusual results. For example as shown in FIG. 1*a*, [FIGS. 1*a*–7 (except 1*f*) are drawn to scale]the area of the control valve piston exposed to the effect of the pressure of fluid in the annulus flowing in through port 63 is greater than the area of the piston affected by the pressure of the casing fluid so that the overpressure piston 30 does not react to casing fluid pressure and, if the bladder ruptures, the spring 71 can close the valve with the help of the annulus pressure pushing on the larger area (larger than the area exposed to casing fluid) of the control valve sliding piston 20.

Figure 7:
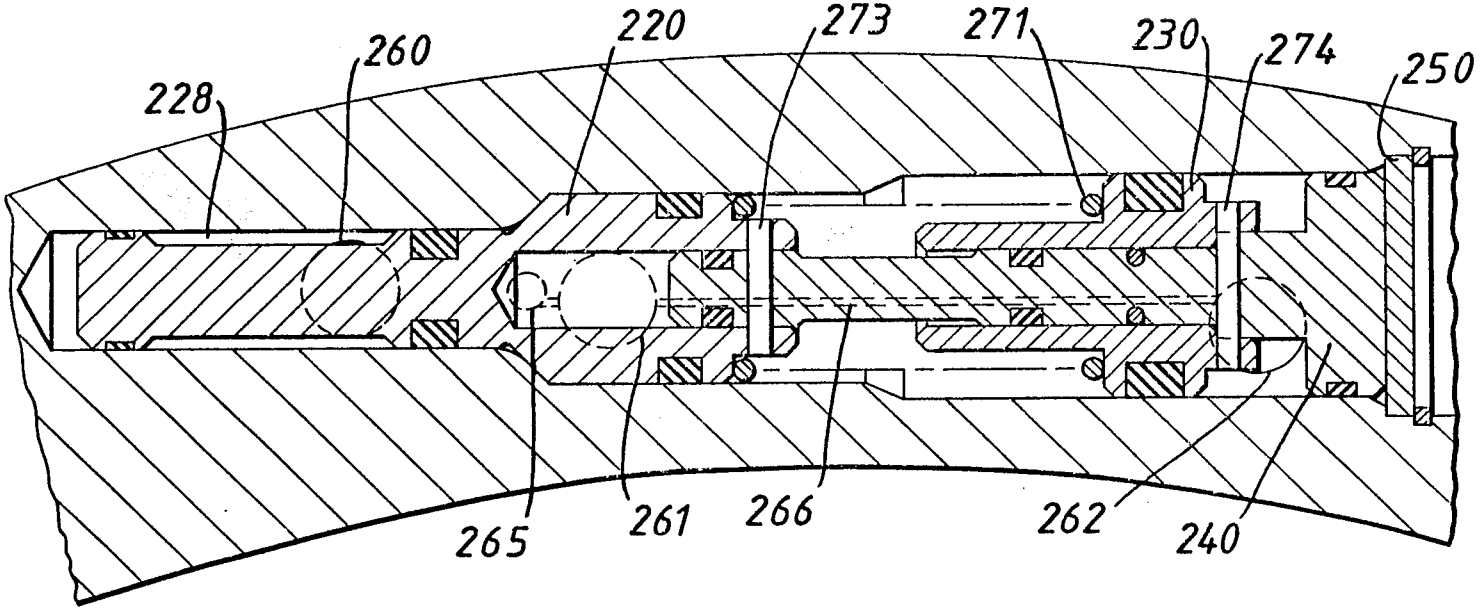
FIG. 7 is a top cross sectional view of a valve assembly according to the present invention in a single cavity in a casing coupling within a wellbore.

In the embodiment illustrated in FIG. 7, the balancing locking stem 240 is always permanently connected to the annulus gland 250. The control valve sliding piston 220 is prevented from opening the valve by opening shear pin 273 which runs through the piston 220 and the stem 240. Initially the overpressure piston is held on the stem 240 by means of the closing shear pin 274. When the pressure of the casing fluid through the port 260 reaches a predetermined level, the opening shear pin 273 shears, the control valve piston 220 moves toward the end of the cavity 228 in which the annulus gland 250 is mounted, the spring 271 is compressed against both the pistons 220 and 230, and casing fluid flows through the port 261 into the bladder element.

The side of the overpressure piston 230 near the annulus gland 250 is exposed to the pressure of the fluid in the bladder via the overpressure port 262. At a predetermined level of pressure the closing shear pin 274 is sheared and the overpressure piston 230 moves to compress the spring 271 and force the control valve sliding piston 220 to close off bladder port 261. Also, the pressure of fluid in the bladder can be communicated to the control valve sliding piston via the channel 266 (which can intersect with port 262) and the port 265 to provide further force for closing the valve. Because the number of moving parts in the embodiment of FIG. 7 is limited (e.g. the stem 240 is immobile), this embodiment provides a relatively quicker response to pressure changes.

In conclusion, therefore, it is seen that the present invention disclosed herein is an elegant solution to the problems encountered with multi-valve multi-cavity systems and well adapted to carry-out the purposes set forth and has the advantages mentioned as well as others inherent therein. Certain changes can obviously be made in the structure and dimensions of the assembly as claimed without departing from the spirit and scope of the invention claimed in the following claims.

What is claimed is:

1. A valve assembly for controlling the flow of fluid from within casing into a bladder element of an inflatable packer for use in a wellbore, the bladder element having bladder port means, the valve assembly mountable within a single cavity in a body member in the wall of casing or a casing coupling, the body member having casing port means communicating with the cavity for communicating casing fluid to the bladder port means so that the casing fluid can flow through the bladder port means to inflate the bladder element and the body member having overpressure port means communicating with the cavity for communicating part of the fluid flowing into the bladder element back to the cavity and to the valve assembly, the valve assembly comprising control piston means movably mounted within the cavity, the control piston means movable from a first position in which the control piston means closes off the casing port means and the bladder port means to the flow of casing fluid, to a second position in which casing fluid flows through the casing port means and bladder port means into the bladder element, restraint means for insuring that the control piston means initially moves only when the pressure of the casing fluid reaches a predetermined level, and closing piston means movably mounted within the cavity and responsive to the pressure of the fluid in the bladder element, a portion of the fluid in the bladder element communicating with the closing piston means through the overpressure port means, so that when the pressure of the fluid in the bladder element reaches a predetermined level the closing piston means moves to contact and push the control piston means back into the first position, closing off the casing port means and sealing the casing fluid within the casing and closing off the bladder port means thereby maintaining the pressure of the fluid in the bladder element, and the control piston means and the closing piston movable about stem means disposed in the cavity.

2. The valve assembly of claim 1 wherein said closing piston means is secured to the stem means by closing shear means and wherein the stem means is secured to gland means disposed in an end of the cavity opposite from the end in which the control piston means is disposed, the restraint means securing the stem means to the gland means, the restraint means including opening shear means which require to a predetermined force to be sheared, the opening shear means thereby permitting the stem means and the closing piston means to move in response to the control piston means, the predetermined force being greater than the force necessary to shear the closing shear means, and the force for shearing the opening shear means being transmitted to the opening shear means by the casing fluid's effect on the control piston means through the closing piston means and the stem means.

3. The valve assembly of claim 2 wherein the closing piston means is freed to contact and move the control piston means when the pressure of the fluid in the bladder element has reached a predetermined level at which level the force of the fluid shears the closing shear means thereby freeing the closing piston means, the force then pushing the closing piston means to move the control piston means into a position closing off the casing port means and bladder port means.

4. The valve assembly of claim 3 also including annulus port means for permitting fluid in an annulus between the casing or casing coupling and the wellbore to flow into the cavity at such a point that the annulus fluid flows into the cavity and acts upon the control piston means to move the control piston means into a position closing off the casing port means and bladder port means.

5. The valve assembly of claim 1 including closing locking means for locking the control piston means in position closing off the casing port means and bladder port means.

6. The valve assembly of claim 1 wherein the stem means is movable in the cavity and including closing locking means for locking the control piston means in position closing off the casing port means and bladder port means, the closing locking means comprising expandable ring means on the stem means which expands when the control piston means moves to the closed position, the ring means expanding to abut a portion of the control piston means thereby preventing further movement of the control piston means.

7. The valve assembly of claim 1 wherein the stem means is movable in the cavity and stem locking means are provided to lock the stem means in position.

8. The valve assembly of claim 7 wherein the stem locking means comprises expandable ring means for expanding into a recess in the gland means for holding the stem means in position.

9. The valve assembly of claim 8 wherein the recess is so configured that limited movement of the stem means is permitted after the ring means has expanded.

10. The valve assembly of claim 1 wherein means is provided to permit the flow of a portion of the casing fluid into and out of the space previously occupied by the control valve piston means when it has moved in the cavity in opening or in closing the casing port means and bladder port means.

11. The valve assembly of claim 1 wherein the stem means is movable within the cavity and wherein means is provided to permit annulus fluid to flow into and out of the space previously occupied by the stem means when the stem means moves during the opening or closing of the casing port means and bladder port means.

12. The valve assembly of claim 1 wherein the stem means is movable in the cavity and wherein two opposite ends of the stem means are exposed to annulus fluid, the ends having the same area so that the stem means will not move in response to the pressure of the annulus fluid.

13. The valve assembly of claim 12 wherein the annulus fluid flows through a port in gland means, the gland means disposed in the end of the cavity opposite the end in which the control piston means is disposed, the stem means having channel means therethrough for communicating the annulus fluid to the other end of the stem means.

14. The valve assembly of claim 13 wherein the annulus fluid communicated through the channel means in the stem means impacts a portion of the control piston means for assisting in moving he control piston means to the closed position.

15. The valve assembly of claim 1 wherein said control piston means has a first portion disposed in a first end of the cavity and a second portion wider than the first portion disposed in a second part of the cavity wider than and adjacent to the first end, the first portion of the control piston means having mounted thereto sealing means for coacting with the walls of the cavity's first end to prevent casing fluid from flowing beyond the control piston means, the second portion of the control piston means having sealing means for coacting with the walls of the cavity's second part to provide a seal for preventing the flow of casing fluid beyond the control piston means after the casing port means and bladder port means have been opened and the control piston means has moved to close them off.

16. A valve assembly for controlling fluid flow through a single cavity in a body member, said valve assembly disposed within said single cavity and comprising:

controlling means for controlling the flow of a first fluid under pressure flowing into said cavity through a first inlet disposed in said body member communicating with said cavity and flowing out of said cavity through a first outlet disposed in said body member communicating with said cavity, said controlling means responsive to the pressure of said first fluid so that it is activated to permit flow of the first fluid through the first inlet and out of the first outlet only when the pressure of the first fluid reaches a predetermined level, said controlling means comprising control piston means movable in said cavity to close off or to open the first inlet and the first outlet, said control piston means movable about a stem means disposed in said cavity and closing means coacting with said controlling means for closing off said first inlet and said first outlet, said closing means responsive to the pressure of said first fluid which has flowed through the first outlet so that said closing means is activated when the pressure of said first fluid which has flowed through said first outlet reaches a predetermined level, said closing means comprising closing piston means movable in said cavity to contact and move said control piston means to close off the first inlet and the first outlet, said control piston means movable about said stem means.

17. The valve assembly of claim 16 wherein said stem means is movable within gland means mounted in said cavity, said gland means having an opening therein in which part of said stem means is exposed to the pressure of fluid exterior to the cavity other than the first fluid.

18. The valve assembly of claim 17 wherein said closing piston means is secured to said stem means by closing shear means and said stem means is secured to said gland means by opening shear means so that the force required to shear the opening shear means is predetermined force and is less than the force required to shear the closing shear means and the effect of the pressure of the first fluid is transmitted to said opening shear means to shear it, the force transmitted through said control piston means in contact with said closing piston means which is connected to said stem means.

19. The valve assembly of claim 18 wherein said closing piston means is freed to contact and move said control piston means when the pressure of said first fluid having flowed through said first outlet has reached a predetermined level, at which level the force of said first fluid shears said closing shear means freeing said closing piston means.

20. The valve assembly of claim 19 wherein said stem is movable by the control piston after said closing shear means has been sheared.

21. The valve assembly of claim 20 wherein the control piston means is also acted upon by fluid exterior to the cavity other than the first fluid at such a point that the exterior fluid assists the closing piston means in pushing the control piston means back into a position in which the first inlet and the first outlet are closed off.

22. The valve assembly of claim 16, also including closing locking means for locking said control piston means in such a position that the first inlet and the first outlet are closed off.

23. The valve assembly of claim 16 wherein the stem means is movable in the cavity and wherein closing locking means are provided for locking said control piston means in position closing off the first inlet and the first outlet, the closing locking means comprising expandable ring means on said stem means which expand when the control piston means moves to the position closing off the first inlet and first outlet, the ring means expanding to abut a portion of said control piston means thereby preventing further movement of said control piston means.

24. The valve assembly of claim 18 wherein stem locking means are provided to lock said stem means in position.

25. The valve assembly of claim 24 wherein the stem locking means comprises expandable ring means on said stem means and a gland means recess within said gland means for receiving and holding said expandable ring means after its expansion thereby preventing movement of said stem means.

26. The valve assembly of claim 25 wherein the recess is so configured that limited movement of said stem means is permitted after the ring means has expanded into the recess.

27. The valve assembly of claim 16 wherein means is provided to permit the flow of a portion of the first fluid into and out of the space previously occupied by the control piston means when it has moved in the cavity to open the first inlet.

28. The valve assembly of claim 18 wherein the control piston means has a control recess therein for receiving the stem means and wherein means is provided to permit the flow of fluid exterior to the cavity other than the first fluid into the control recess when the stem means has moved out of the recess during the opening of the first inlet.

29. A valve assembly for controlling fluid flow through a single cavity in a body member, said valve assembly disposed within said single cavity and comprising:

controlling means for controlling the flow of a first fluid under pressure flowing into said cavity through a first inlet in said body member communicating with said cavity and flowing out of said cavity through a first outlet in said body member communicating with said cavity, said controlling means responsive to the pressure of said first fluid so that it is activated to permit flow of the first fluid through the first inlet and out of the first outlet only when the pressure of the first fluid reaches a predetermined level, said controlling means comprising control piston means movable in said cavity about stem means disposed in said cavity, closing means coacting with said controlling means for closing off said first inlet and said first outlet, said closing means responsive to the pressure of said first fluid which has flowed through the first outlet so that said closing means is activated when the pressure of said first fluid which has flowed through said first outlet reaches a predetermined level, said closing means comprising closing piston means movable in said cavity about the stem means, said closing piston means movable in said cavity to contact and move said control piston means to close off the first inlet and the first outlet, said stem means extending partially within said control piston means, partially within said closing piston means, and partially within gland means mounted in said cavity, said closing piston means secured to said stem means by closing shear means and said stem means is secured to said gland means by opening shear means so that the force required to shear the opening shear means is a predetermined force and is less than the force required to shear the closing shear means and the effect of the pressure of the first fluid is transmitted to said opening shear means to shear it, the force transmitted through said control piston means in contact with said closing piston means which is connected to said stem means, said closing piston means movable to contact and move said control piston means when the pressure of said first fluid having flowed through said first outlet has reached a predetermined level, at which level the force of said first fluid shears said closing shear means freeing said closing piston means, closing locking means for locking said control piston means in such a position that the first inlet and the first outlet are closed off, and stem locking means for locking said stem means in position with said gland means.

30. The valve assembly of claim 18 wherein two opposite ends of said stem means are exposed to fluid from the exterior of said cavity, the ends having the same area so that said stem means will not move in response to the pressure of the fluid from the exterior of said cavity.

31. The valve assembly of claim 30 wherein the fluid from the exterior of said cavity is communicated through a port in the gland means to one end of the stem means and to the other end of said stem means via a channel within said stem means.

32. The valve assembly of claim 18 wherein channel means are provided in said stem means for communicating fluid from the exterior of the cavity other than the first fluid to a zone adjacent a portion of the control piston means so that the pressure of said exterior fluid can assist in moving the control piston means to close off the first inlet and first outlet.

33. The valve assembly of claim 18 wherein said control piston means is a single control piston having a first portion and a second portion wider than the first portion, the cavity having a first area for containing the first portion of the control piston and a second wider area for containing the second portion of the control piston, the second area adjacent the first, the first portion of the control piston having sealing means for coacting with the walls of the cavity first area to provide a seal for preventing the flow of casing fluid beyond the control piston prior to the opening of the first inlet, and the second portion of the control piston having sealing means for coacting with the walls of the cavity second area to provide a seal for preventing the flow of the first fluid beyond the control piston after the first inlet has been opened and the control piston has moved to close it off.

* * * * *